US005660327A

United States Patent [19]

Brinkley, Jr.

[11] Patent Number: 5,660,327

[45] Date of Patent: Aug. 26, 1997

[54] MAILBOX DELIVERED MAIL SIGNAL

[76] Inventor: Amiel W. Brinkley, Jr., 34 Buerger Rd., Mobile, Ala. 36608

[21] Appl. No.: 447,785

[22] Filed: May 23, 1995

[51] Int. Cl.[6] ..... B65D 91/00

[52] U.S. Cl. ..... 232/35

[58] Field of Search ..... 232/34, 35, 17; D99/29

[56] References Cited

U.S. PATENT DOCUMENTS

| | | | |
|---|---|---|---|
| D. 260,319 | 8/1981 | Kuntz | D99/29 |
| D. 314,852 | 2/1991 | Taylor | D99/29 |
| D. 335,747 | 5/1993 | Dearing et al. | D99/29 |
| 2,480,469 | 8/1949 | Horn | 232/35 |
| 2,808,982 | 10/1957 | Armstrong | 232/35 |
| 3,815,811 | 6/1974 | Harmon | 232/35 |
| 3,889,874 | 6/1975 | Arwood | 232/35 |
| 3,904,108 | 9/1975 | File | 232/35 |
| 4,073,430 | 2/1978 | Joris | 232/35 |
| 4,205,778 | 6/1980 | File | 232/35 |
| 4,491,268 | 1/1985 | Faulkingham | 232/35 |
| 4,524,905 | 6/1985 | Crist | 232/35 |
| 4,753,386 | 6/1988 | Phillion | 232/43.1 |
| 4,953,783 | 9/1990 | Chambers | 232/35 |
| 5,092,517 | 3/1992 | Jeffries et al. | 232/35 |
| 5,094,386 | 3/1992 | Tabacco | 232/35 |
| 5,119,986 | 6/1992 | Kobilarcik et al. . | |
| 5,123,590 | 6/1992 | Teele | 232/35 |
| 5,201,465 | 4/1993 | Limehouse | 232/35 |
| 5,255,843 | 10/1993 | Deakyne | 232/35 |
| 5,273,207 | 12/1993 | Johnson | 232/35 |
| 5,284,295 | 2/1994 | Steinfeldt | 232/35 |

*Primary Examiner*—Kenneth J. Dorner
*Assistant Examiner*—Jerry Redman

[57] ABSTRACT

A system added to a mailbox having a hinged door, said system exposing a visible signal when the mailbox door is opened for mail delivery and then closed. A receptacle (10), fixed in an elevated position to the side of the mailbox, or to its enclosure, holds a delivery indicator (14) which is connected to the mailbox door through a flexible connector (18), such as a monofilament plastic line, and then a fastener (22) that is fastened to the door. When the door is opened this action pulls the delivery indicator (14) free of the receptacle (10). When the door is closed the delivery indicator (14) hangs in a visible position below the mailbox.

4 Claims, 2 Drawing Sheets

MAILBOX DELIVERED MAIL SIGNAL

BACKGROUND

1. Field of Invention

This invention relates to common mailboxes, specifically an improved system for visibly indicating when mail has been placed into a mailbox that stands by the street or road.

2. Description of Prior Art

Some owners of mailboxes that stand beside the street, highway or road, away from the residence or business, would benefit from being able to see when mail has been placed in the mailbox. Such a signal would save unnecessary walks to the to the mailbox or unnecessary excursions from a returning vehicle. A number of United States patents have been issued for devices that expose a visible component when the mailbox door is opened for mail delivery and then closed.

Design Pat. No. 335,747 (1993, Dearing and Walker) covers a device that pushes a metal flag from a position on the side of the mailbox, which flag then hangs below to become a visible signal.

U.S. Pat. Nos. Des. 314,852 (1991, Taylor): 5,123,590 (1992, Teele); 5,119,986 (1992, Kobilarcik and Weyer); 5,094,386 (1992, Tabacco); 4,524,905 (1985, Crist) and 4,491,268 (1985, Faulkingham) describe spring or coil mounted flags on top of, or on the side of, the mailbox that must be put in the horizontal position and held there by the closed mailbox door and, when the door is opened, are released to the vertical and visible position. Somewhat similarly, U.S. Pat. Nos. 4,953,783 (1990, Chambers) and 3,815,811 (1974, Harmon) describe a pivoting flag attached to the side of and near the bottom of the mailbox and held horizontal by a hook on the mailbox door. Opening the mailbox door disengages the hook from the flag, allowing it to pivot downward and become visible to the owner.

U.S. Design Pat. No. 260,319 (1981, Kuntz) is for a spherical object connected by a chain to the mailbox door, said object being hung on a protrusion on the mailbox door until the door is opened, at which time the object falls and becomes visibly suspended below the mailbox by the connecting chain. In 1994, a somewhat similar device was patented (U.S. Pat. No. 5,284,295, Steinfeldt).

U.S. Pat. No. 5,273,207 (1993, S. C. Johnson) is for a device attached to the mailbox door latches that changes position, producing a delivery signal, when the mailbox door is opened and closed. U.S. Pat. No. 5,255,843 (1993, Deakyne) describes a battery powered electrical alarm, i.e., light, that is turned on by a switch mounted to the mailbox and connected to the mailbox door, said alarm being actuated when the door is opened and closed. U.S. Pat. No. 5,201,465 (1993, Limehouse) is for a mailbox mounted on a hollow platform containing a lever that is actuated by opening the mailbox door, thereby exposing, to the owner's view, a signal rod mounted at the rear of the mailbox.

U.S. Pat. No. 5,092,517 (1992, Jeffries and Harper) is for a flag plate hinged to the underneath surface of a mailbox and held horizontally and out of sight by a rod connected to the mailbox door, said rod being pushed away from the flag plate when the door is opened, allowing the flag plate to fall to a visible, vertical position. U.S. Pat. No. 4,753,386 (1988, Phillion) describes a flexible cable attached at one end to the inside of the mailbox door and at the other end to a pivotal flag assembly which is raised to a visible, vertical position by opening the door, remaining in that position until manually returned to the hidden position.

U.S. Pat. No. 3,889,874 (1975, Arwood) describes a mechanism mounted inside the mailbox, consisting of a spring loaded, sliding rod that exposes a signal atop the mailbox when the door is opened.

The devices described above, as well as numerous other patented devices designed to accomplish the same purpose, generally have the following disadvantages:

(a) They require tools and some degree of mechanical skill to install on the mailbox.

(b) They require two free hands to reset the device.

(c) They are undesirably conspicuous on the mailbox at all times.

(d) Many have metal parts that can rust in the outdoors.

(e) Their metal parts must be manufactured using machine tools.

(f) The devices are difficult to be made unnoticeable when the owner is absent for several days.

(g) Some devices include attachments to the outside of the mailbox door that interfere with the postman as he/she opens the door.

OBJECTS AND ADVANTAGES

Accordingly, several objects and advantages of my invention are:

1. To provide a system that is attached to the common mailbox and which, when the mailbox door is opened and closed, produces a visible signal. The advantages of my system are:

(a) The system can be easily installed on the mailbox without any tools, such as those required to drill holes and to fasten nuts and bolts;

(b) The system contains no metal parts that can rust and corrode and which generally require machine tools to cut and form to desired patterns:

(c) The system can be made from materials readily available at retail stores, using common household cutting and smoothing tools:

(d) The system is quite inconspicuous in the reset position, a feature desired by many home and business owners:

(e) The system can be easily reset with one hand while the other hand is occupied by holding mail;

(f) The system can be easily set to give no signal when such is desired, i.e., the owner is away for several days.

(g) The system does not interfere with the postman as he/she opens and closes the door.

Still further objects and advantages will become apparent from a consideration of the ensuing description and drawings.

DRAWING FIGURES

Figure 1A:
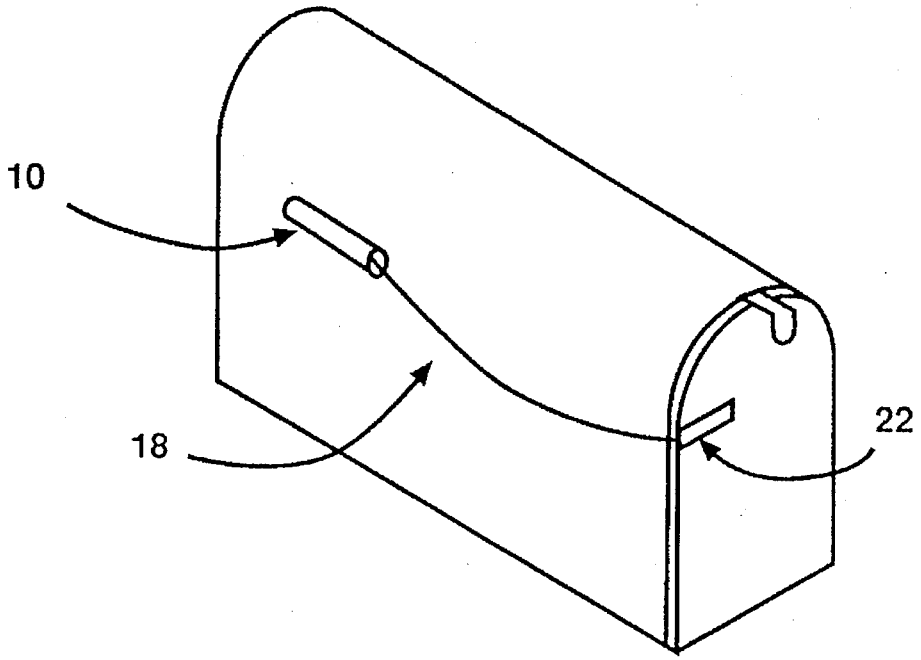
FIG. 1A is a view of a mailbox equipped with my invention, the latter being in the set, or armed, mode.

| Reference Numerals in the Drawing | |
|---|---|
| 10 receptacle | 18 connector |
| 14 delivery indicator | 22 fastener |

Figure 1B:
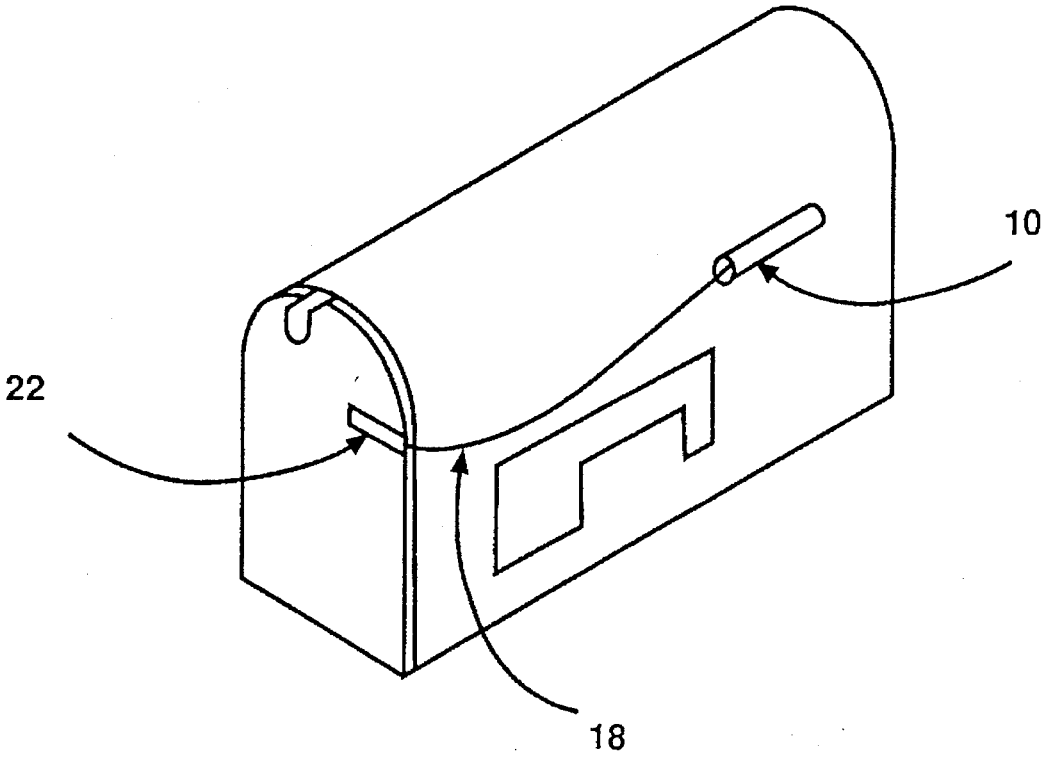
FIG. 1B shows the same mailbox from the opposite side.

A typical embodiment of the delivery indicator system of my invention is illustrated in FIGS. 1A and 1B. A receptacle 10 holds a delivery indicator 14 against the side of the mailbox and out of view. Connector 18 is a length of material fastened at one end to delivery indicator 14 and, at the other end, to fastener 22 that secures connector 18 to the mailbox door.

Receptacle 10 can be a shelf, tray or hollow device, such as a tube or pipe, and made of a noncorroding material such as plastic, wood glass or noncorroding metal. Suitably, receptacle 10 is a plastic tube that can receive the delivery indicator 14, which, in this case, suitably would be a length of material such as wood or plastic. Receptacle 10 can be attached to the side of the mailbox with adhesive coated strips of material such as cloth, plastic or paper, containing adhesive on both surfaces. Such adhesive coated strips can be purchased containing protective outer layers of material which can be peeled by hand from the adhesive, rendering it ready to use. Use of a hook and loop fastener gives very good bonding between the curved surface of a tube and the flat surface of a mailbox. Receptacle 10 is preferably adhered to the rear of, and near the top of, the vertical side of the mailbox.

Delivery indicator 14 should be of such dimensions as to fit onto or within receptacle 10. A suitable version is to make delivery indicator 14 out of wood or plastic with a cross section fitting onto or within receptacle 10, and with a length that is maximum for visibility but short enough that opening the mailbox door will pull it free of receptacle 10. Delivery indicator 14 can be painted or coated with a highly visible, fluorescent material and, for improved visibility, can contain colored ribbon attached at the end opposite that to which connector 18 is fixed.

Connector 18 can suitably be made of a flexible material such as woven string of synthetic or natural fibers, monofilament plastic or weather proof chain and can be fastened to the delivery indicator 14 in a number of ways. These can include adhesive backed tape, glue or hot melt adhesive or by tying the connector 18 to the delivery indicator 14 through a hole or around the tape. Noncorroding metal staples or screwed in eyelets can also be used for attaching connector 18 to delivery indicator 14. Connector 18 can be secured to fastener 22 in a number of ways, including, but not limited to, tying connector 18 through a hole in one end of fastener 22. Other means can include using noncorroding metal staples and high bonding strength adhesive tape.

Fastener 22 is preferably located at the top of the verticle straight side of the mailbox door.

OPERATION

FIGS. 1A and 1B show a typical mailbox, equipped with my invention, in the mode of awaiting the delivery of mail, with the mailbox door in the closed position. Receptacle 10, fixed to one external side of the mailbox, contains delivery indicator 14, which is connected to fastener 22 and, thus, to the mailbox door, by connector 18.

Figure 2:
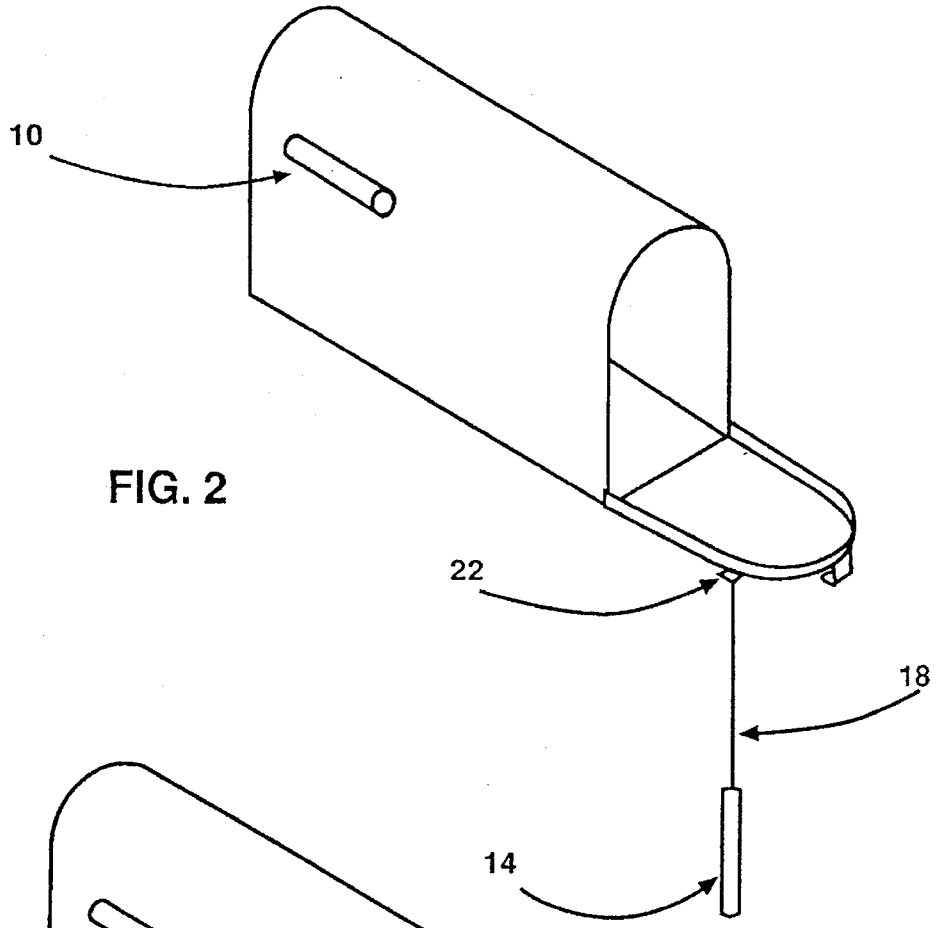
FIG. 2 shows the positions of the mailbox and my invention when the mailbox door is opened.

FIG. 2 shows the mailbox, equipped with my invention, in the mode of having been opened for placing of mail thereinto. Delivery indicator 14 has been pulled free of receptacle 10 by the horizontal movement of the point on the mailbox door to which delivery indicator 14 is attached through connector 18 and fastener 22.

Figure 3:
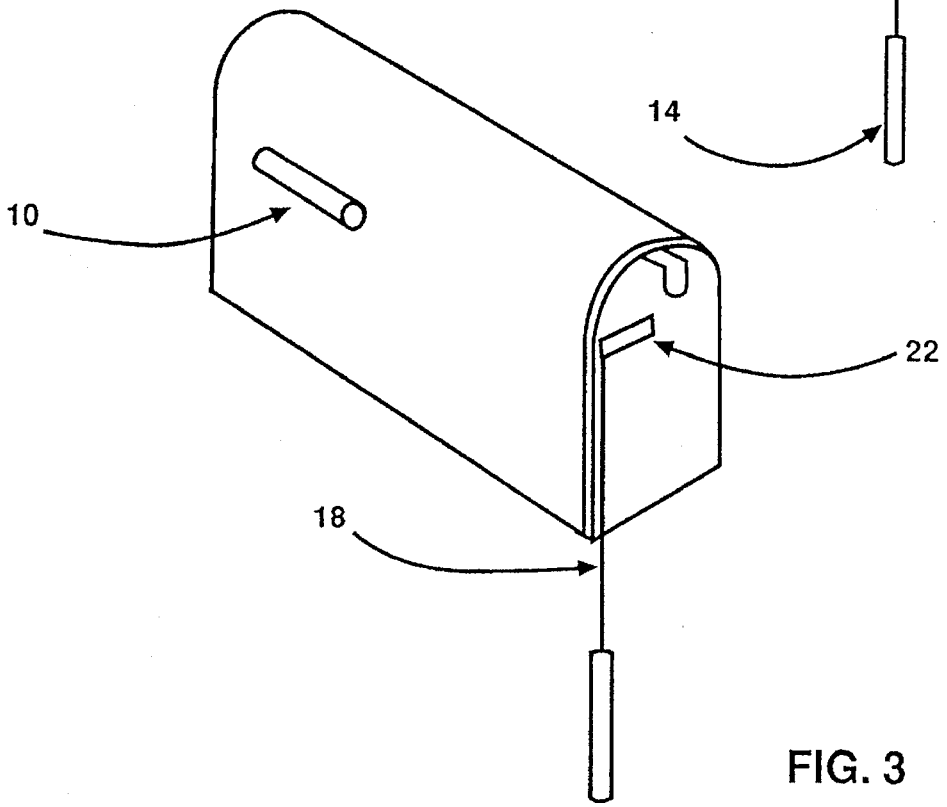
FIG. 3 shows the positions of the mailbox and my invention after the mailbox door has been closed by the postman.

FIG. 3 shows the same mailbox after the mailbox door has been closed by the postman and before the mailbox has been emptied by the owner, who, at that time, would replace delivery indicator 14 into receptacle 10. FIG. 3 shows delivery indicator 14 hanging below the mailbox and visible to the owner from a distance, making the owner aware that mail has been placed in the mailbox.

The design of the mailbox equipped with my invention would dictate such dimensions as:

1. Overall length of delivery indicator 14. This length must not exceed the horizontal distance displaced by the point at which connector 18 is fixed to the mailbox door by fastener 22. Otherwise, opening the mailbox door will fail to pull delivery indicator 14 free of receptacle 10 and thus would not allow delivery indicator 14 to fall and hang free and visible in the vertical position.

2. Overall length of connector 18. FIG. 3 shows that, when the mailbox door is closed and delivery indicator 14 is hanging freely from fastener 22, the length of connector 18 must be sufficient to allow delivery indicator 14 to hang well below the bottom of the mailbox in order to be visible to the user. For example, on the most commonly used U.S. Government designed household mailbox, the distance from the top of the vertical straight side of the mailbox door to the bottom of the door is about 18 cm (7 in). An appropriate length of connector 18, in this case, would be about 30 cm (12 in), thus allowing delivery indicator 14 to hang about 12 cm (5 in) below the bottom of the mailbox.

The cross section of delivery indicator 14 is only critical to the extent that this component is usefully visible to the user from the distance from which the user can see the mailbox. For example, a delivery indicator 14, made of a wood or plastic dowel or of a section of pipe, having a cross section diameter of about 1.25 cm (0.5 in), is clearly visible from a distance of up to about 60 m (200 ft). Visibility of delivery indicator 14 is significantly enhanced by painting or coating this component with a fluorescent material and by attaching a brightly colored flexible material, such as a ribbon or streamer, to the component.

CONCLUSIONS, RAMIFICATIONS AND SCOPE OF INVENTION

In conclusion, the mailbox delivery indicator system of this invention is very easy to install, is simple to operate and provides the owner the convenience of seeing from a distance when mail has been placed in the owner's mailbox. The basis for the uniqueness of this invention is the simple mechanical action of a signalling device being pulled from a hidden position by opening the mailbox door and this device then falling and hanging in a visible position.

While the above description of my invention covers a practiced and proven embodiment, several ramifications would perform adequately, as well. For example, delivery indicator 14 could be a sphere or a twisted flat piece of material that would oscillate in a breeze. The position of a particular mailbox might require that receptacle 10 be placed other than on the side of the mailbox, for example, on an enclosure of which the mailbox is a part.

It follows that the scope of this invention should be determined by the appended claims and their legal equivalents, rather than being limited to the examples presented above.

I claim:

1. A delivered mail indicating system combined with a mailbox having a hinged door through which articles are inserted and removed, said delivered mail indicating system comprising:

a. a delivery indicator that is a solid object, b. a receptacle to receive, hold and release said delivery indicator, said receptacle being in a fixed position outside of said mailbox, c. a connecting means attached, at one end, to said delivery indicator and, at the opposite end, to a fastening means that attaches said connecting means to said hinged door at a point on said hinged door that provides a means for pulling said delivery indicator free from said receptacle when said hinged door is opened and closed, whereby said delivery indicator falls by gravity and hangs beneath said mailbox, being visible from essentially all directions.

2. The delivered mail indicating system of claim 1 wherein said receptacle is a hollow device into which said delivery indicator can be placed.

3. The delivered mail indicating system of claim 1 wherein said delivery indicator is an elongated solid member.

4. The process of indicating mail has been delivered and deposited into a mailbox having a hinged door, said process comprising the steps of:

a. providing a receptacle that holds and releases a visible solid delivery indicator, said delivery indicator being attached to a connecting means, said connecting means being attached, at the opposite end, to a fastening means, said fastening means being attached to said hinged door;

b. opening said hinged door on said mailbox to insert objects, an opening movement pulling said delivery indicator from said receptacle;

c. closing said hinged door, a closing movement leaving said delivery indicator hanging beneath said mailbox in a visible position.

* * * * *